US010201885B2

(12) United States Patent
Azami Gilan et al.

(10) Patent No.: US 10,201,885 B2
(45) Date of Patent: Feb. 12, 2019

(54) ROTATIONAL ABRASIVE MICRO/NANO-FINISHING

(71) Applicants: Aref Azami Gilan, Kermanshah (IR); Abdolhamid Azizi, Ilam (IR)

(72) Inventors: Aref Azami Gilan, Kermanshah (IR); Abdolhamid Azizi, Ilam (IR)

( * ) Notice: Subject to any disclaimer, the term of this patent is extended or adjusted under 35 U.S.C. 154(b) by 0 days.

(21) Appl. No.: 15/338,382

(22) Filed: Oct. 29, 2016

(65) Prior Publication Data

US 2017/0043447 A1 Feb. 16, 2017

Related U.S. Application Data

(60) Provisional application No. 62/297,958, filed on Feb. 22, 2016.

(51) Int. Cl.
*B24B 31/10* (2006.01)

(52) U.S. Cl.
CPC ..... *B24B 31/10* (2013.01)

(58) Field of Classification Search
CPC ..... B24B 31/10
USPC ..... 451/104, 106, 113, 36, 1, 28
See application file for complete search history.

(56) References Cited

U.S. PATENT DOCUMENTS 6,688,953 B2 * 2/2004 Kawasaki ..... B24B 1/00 451/106
6,905,395 B2 6/2005 Walch
6,962,522 B1 * 11/2005 Kawasaki ..... B24B 31/003 451/104
2014/0220869 A1 * 8/2014 Tzeng ..... B24B 31/003 451/113

FOREIGN PATENT DOCUMENTS

CN 100546764 C 10/2009
CN 102501179 B 9/2013
IN 2699/DEL/2011 A 10/2011
KR 100257847 B1 6/2000

OTHER PUBLICATIONS

Mamilla Ravi Sankar, Experimental investigations into rotating workpiece abrasive flow finishing, Wear , Nov. 2008, vol. 267, pp. 43-51.

(Continued)

*Primary Examiner* — Robert Rose

(74) *Attorney, Agent, or Firm* — Bajwa IP Law Firm; Haris Zaheer Bajwa

(57) ABSTRACT

Disclosed herein is a method for inner surface finishing of a workpiece, in which the inner surface of the workpiece defines an opening with axial symmetry around the longitudinal axis of the workpiece. The method may include the following steps. An abrasive medium may be poured inside the opening; urging the abrasive medium to rotate about the longitudinal axis, thereby imposing a centrifugal force on the abrasive medium to accelerate the abrasive medium outwards from the center of rotation towards the inner surface of the opening, where the abrasive medium impacts the inner surface of the opening; and the workpiece may be rotated about the longitudinal axis in a direction opposite the first direction, concurrently.

13 Claims, 11 Drawing Sheets

(56) References Cited

OTHER PUBLICATIONS

Mamilla Ravi Sankar, Rotational abrasive flow finishing (R-AFF) process and its effects on finished surface topography, International Journal of Machine Tools & Manufacture, Mar. 2010, vol. 50, pp. 637-650.

R. S. Walia, Morphology and integrity of surfaces finished by centrifugal force assisted abrasive flow machining, Journal of advance manufacturing technology, Dec. 2007, vol. 39, pp. 1171-1179.

V.K. Jain, Magnetic field assisted abrasive based micro-/nano-finishing, Journal of Materials Processing Technology , 2009, vol. 209, pp. 6022-6038.

Biing-Hwa Yan, Finishing effects of spiral polishing method on micro lapping surface, International Journal of Machine Tools & Manufacture, Oct. 2006, vol. 47, pp. 920-926.

* cited by examiner

ROTATIONAL ABRASIVE MICRO/NANO-FINISHING

CROSS REFERENCE TO RELATED APPLICATION

This application claims the benefit of priority from pending U.S. Provisional Patent Application No. 62/297,958, filed on Feb. 23, 2016, and entitled "ROTATIONAL ABRASIVE MICRO/NANO-FINISHING APPARATUS," which is incorporated herein by reference in its entirety.

TECHNICAL FIELD

The present disclosure generally relates to methods and devices for surface finishing, and particularly to a rotational abrasive nano/micro finishing method and apparatus.

BACKGROUND

There is an ever-growing need for precisely finished surfaces with surface roughness in the order of micro/nanometer or sub-nanometer in different industries, especially high-tech industries including aerospace, military, automotive, medicine industries, etc. Traditional finishing methods ae not be capable of delivering such a roughness. In order to overcome various limitations of the traditional finishing processes researchers have developed several advanced finishing processes utilizing abrasives to finish the parts made of difficult-to-machine materials having complex geometrical shapes. Finishing rate, material removal and surface texture are the parameters which can be improved, using the advanced finishing methods.

Some of the advanced finishing methods are rather cost or time inefficient, which give rise to a need for an efficient and relatively low-cost method to provide such a finishing functionality to reach micro/nanometric roughness.

SUMMARY

The following brief summary is not intended to include all features and aspects of the present application, nor does it imply that the application must include all features and aspects discussed in this summary.

Various exemplary methods and devices are disclosed, and examples may include a rotating abrasive finishing method and apparatus that may be configured to deliver finishing operation in the order of nanometer.

In one general aspect, the present disclosure describes a method for inner surface finishing of a workpiece, wherein the inner surface of the workpiece defines an opening with axial symmetry around a longitudinal axis of the workpiece. The method may include: pouring an abrasive medium inside the opening; urging the abrasive medium to rotate about the longitudinal axis in a first direction, thereby imposing a centrifugal force on the abrasive medium to accelerate the abrasive medium outwards from the center of rotation towards the inner surface of the opening, where the abrasive medium impacts the inner surface; and concurrently rotating the workpiece about the longitudinal axis in a second direction opposite the first direction.

In another general aspect, the present disclosure describes an apparatus for inner surface finishing of a workpiece, where the inner surface defines an opening inside the workpiece with axial symmetry around a longitudinal axis of the workpiece. The apparatus may include: a fixture configured to house and grip the workpiece; a stirrer having a central shaft and a plurality of radially extending blades connected to the central shaft and rotatable therewith, where the blades may be disposed within the opening defined by the inner surface of the workpiece; a first rotary actuator coupled to the central shaft and configured to drive a rotational movement of the stirrer about the longitudinal axis in a first direction; and a second rotary actuator coupled to the fixture and configured to drive a rotational movement of the fixture about the longitudinal axis in a second direction opposite the first direction. The abrasive medium may be poured between the blades inside the opening and the stirrer may be configured to accelerate the abrasive medium outwards form the center of rotation towards the inner surface of the opening.

In one implementation, the abrasive medium may be a mixture of processing oil and nanoparticles. In other implementations, the nanoparticles may be selected from boron carbide (B4C), silicon carbide (SiC), or combinations thereof.

In an aspect, imposing the centrifugal force to the abrasive medium may include utilizing a rotor to accelerate the abrasive medium outwards from the center of rotation, and the rotor is an impeller blades having different shapes and geometries.

In one implementation, the radially extending blades may have a proximal edge and a distal edge. The proximal edge may be configured to be connected to the central shaft and the distal edge may be shaped such that the horizontal distance between the distal edge and the inner surface of the opening is constant along the vertical length of the blades defining a working gap.

In another implementation, the working gap may define a contact zone for abrasive medium to rotate and impact the inner surface of the opening to perform surface finishing operation.

According to one implementation, the apparatus may include an upper cap and a lower cap placed at either sides of the workpiece and tightly fixed thereon, configured to retain the abrasive medium inside the opening, and the upper cap is configured with a central opening for the central shaft to pass through.

In an aspect, the stirrer and the upper and lower caps may be coaxially placed around the longitudinal axis of the workpiece without any eccentricity.

BRIEF DESCRIPTION OF THE DRAWINGS

While the specification concludes with claims particularly pointing out and distinctly claiming the subject matter that is regarded as forming the present application, it is believed that the application will be better understood from the following description taken in conjunction with the accompanying DRAWINGS, where like reference numerals designate like structural and other elements, in which:

DETAILED DESCRIPTION

Figure 1A:
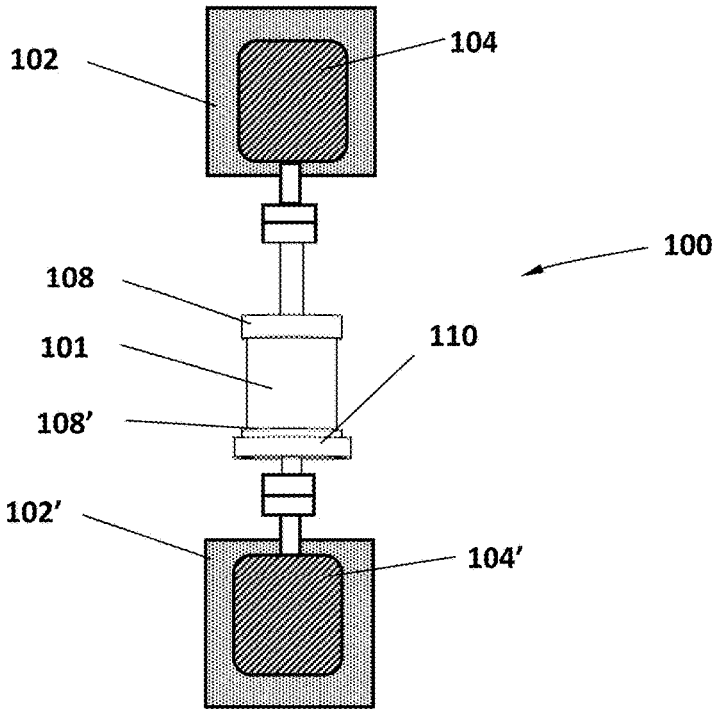
FIG. 1A shows a schematic view of the rotational abrasive finishing apparatus, consistent with one or more exemplary embodiments of the present disclosure.

In the following detailed description, numerous specific details are set forth by way of examples in order to provide a thorough understanding of the relevant teachings. However, it should be apparent that the present teachings may be practiced without such details. In other instances, well known methods, procedures, components, and/or circuitry have been described at a relatively high-level, without detail, in order to avoid unnecessarily obscuring aspects of the present teachings.

For purposes of explanation, specific nomenclature is set forth to provide a thorough understanding of exemplary embodiment of the present disclosure. However, it will be apparent to those skilled in the art that these specific details are not required to practice exemplary embodiments of the present disclosure. Descriptions of specific applications are provided only as representative examples. Various modifications to the exemplary implementations may be readily apparent to one skilled in the art, and the general principles defined herein may be applied to other implementations and applications without departing from the principles of the exemplar embodiment of the present disclosure. Practices according to concepts disclosed by the present disclosure are not intended to be limited to the implementations shown, are to be accorded the widest possible scope consistent with the principles and features disclosed herein.

Disclosed methods and devices herein are directed to a precise finishing of an inner surface of a workpiece, where the inner surface defines an axially symmetric opening inside the workpiece. The method as described herein may include the steps of: first pouring an abrasive medium inside the opening; imposing a centrifugal force on the abrasive medium to accelerate the abrasive medium outwards from the center of rotation towards the inner surface of the opening, where the abrasive medium impacts the inner surface and performs the surface finishing with a micro/nanometric precision. In an implementation, the abrasive medium may be a medium of abrasive nanoparticles.

In an aspect, a stirrer may be used to urge a medium of abrasive nanoparticles that may be poured inside the opening of the workpiece to rotate about the longitudinal axis of the workpiece. This rotational movement may exert a centrifugal force on the abrasive nanoparticles and may accelerate them towards the inner surface of the opening inside the workpiece. The abrasive nanoparticles strike against the inner surface of the workpiece and perform the finishing act. The workpiece itself may rotate about the longitudinal axis of the workpiece in a direction opposite to that of the abrasive nanoparticles.

In some implementations, a rotary actuating mechanism, for example a combination of an electro motor and a gear-box system or a direct drive motor, may be utilized to drive the rotational movement of the stirrer. The stirrer may include a central shaft on which a number of radially extending blades may be attached. The stirrer may be disposed inside the opening and the abrasive medium may be poured between the blades of the stirrer. The rotary actuating mechanism may be coupled with the longitudinal axis of the stirrer and it may be configured to drive a rotational movement of the stirrer. The rotational movement of the stirrer forces the abrasive medium to rotate accordingly. Concurrently, another rotary actuator may be utilized to drive a rotational movement of the workpiece in a direction opposite that of the abrasive medium. To this end, in an implementation, the workpiece may be positioned inside a fixture and be rotatable therewith. The fixture may be coupled to the rotary actuating mechanism and the rotary actuating mechanism may drive the rotational movement of the fixture. In an implementation, the fixture may be designed according to the shape of the workpiece. According to some implementations, there may be a working gap between the stirrer blades and the inner surface of the workpiece.

The opposite direction rotation of the workpiece and the abrasive medium may lead to the abrasive nano-particles to rotate with higher relative velocity that may cause a faster, more precise and cost-efficient finishing. Since nanoparticles are used in the abrasive medium, the surface finishing may be performed with an accuracy in the order of nanometers. In order to facilitate the mounting of the workpiece, the apparatus may be designed in two upper and lower segments mounted vertically, in which the bottom segment is configured to locate the workpiece and the other one is also designed to hold and rotate the stirrer. The workpiece is rotatably mounted on the fixture, and the stirrer is mounted on the upper segment of the apparatus, and rotatable therewith.

Figure 1B:
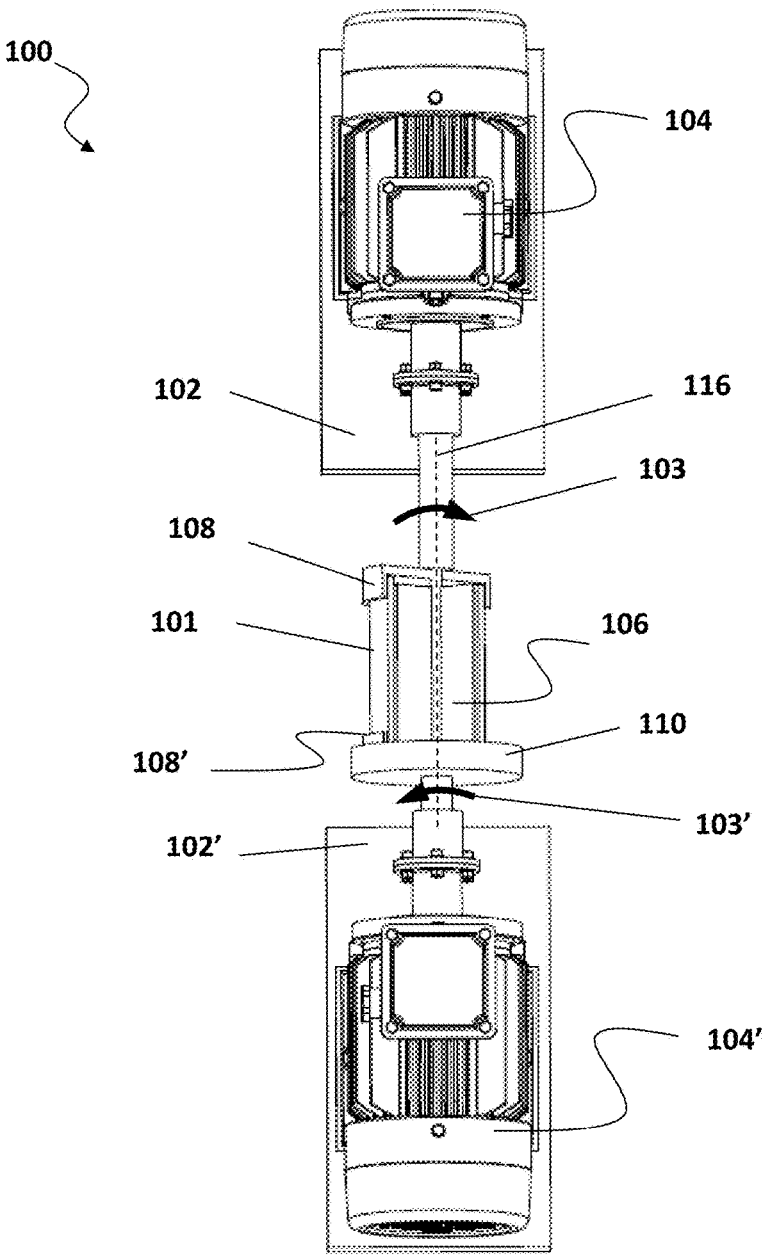
FIG. 1B illustrates an example implementation of the rotational abrasive finishing apparatus with a direct drive actuating mechanism, consistent with one or more exemplary embodiments of the present disclosure.

FIGS. 1A and 1B, show a schematic and top view of an exemplary implementation of the proposed apparatus according to one or more aspects of the present disclosure. Referring to FIGS. 1A and 1B, the exemplary rotational abrasive finishing apparatus 100 of the present disclosure may include: a mounting structure as a frame 102, which may be designed to provide mounting capability for other parts of the apparatus 100; two sets of rotary actuating mechanisms 104 and 104', which may be configured to serve as the power source along with the transmission system which transmits required power with a proper transmission ratio to the following members; a stirrer 106 which may be designed according to the geometrical specifications of the inside surface 101A of the workpiece 101 such as its size and shape and rotatably mounted on the upper segment of the frame 102, connected to the first rotary actuating mechanism 104, in order to provide the system with the rotational means for abrasive medium of nano-particles to rotate and deliver the finishing operation; two caps 108 and 108' which may be placed and fixed on the upper and lower sides of the workpiece (mounted on the lower side in case there is a requirement according to the shape of the workpiece), a fixture 110 that may be designed according to the outside geometry of the surface of the workpiece and coupled with the second rotary actuating mechanism 104', on which the workpiece 101 is rotatably mounted.

Referring to FIGS. 1A and 1B, the rotary actuating mechanisms 104 and 104', as the source of power and power transmission, may be configured to consist of a motor like an electric motor along with a power transmission system such as a pulley and belt system or a gear box system. Also, it is possible to use other forms of rotary actuating mechanisms 104 and 104' such as direct drive motors, which are mounted on the either sections of the frame 102 or 102', as shown in FIG. 1B. The power source provide the required power and the transmission system provide the following elements with the proper rotational speed. The power transmits to the stirrer 106 from the first rotary actuating mechanism 104 through the required coupling means, and the workpiece 101 also receives its required power from the second actuating mechanism 104' through the required coupling means, forcing them to rotate with their corresponding pre-determined rotational speeds, and setting the rotation of the first and second actuating mechanisms 104 and 104' to be in an opposite direction, the stirrer 106 and the workpiece 101 are also forced to rotate in the directions opposite to each other. Such a rotational movements in opposite directions leads to the rotation of medium of abrasive nano particles with higher rotational speed, providing a higher effective normal and tangential finishing forces and producing a polished surface with higher finish quality resulting in a time and cost efficient finishing process.

Figure 4A:
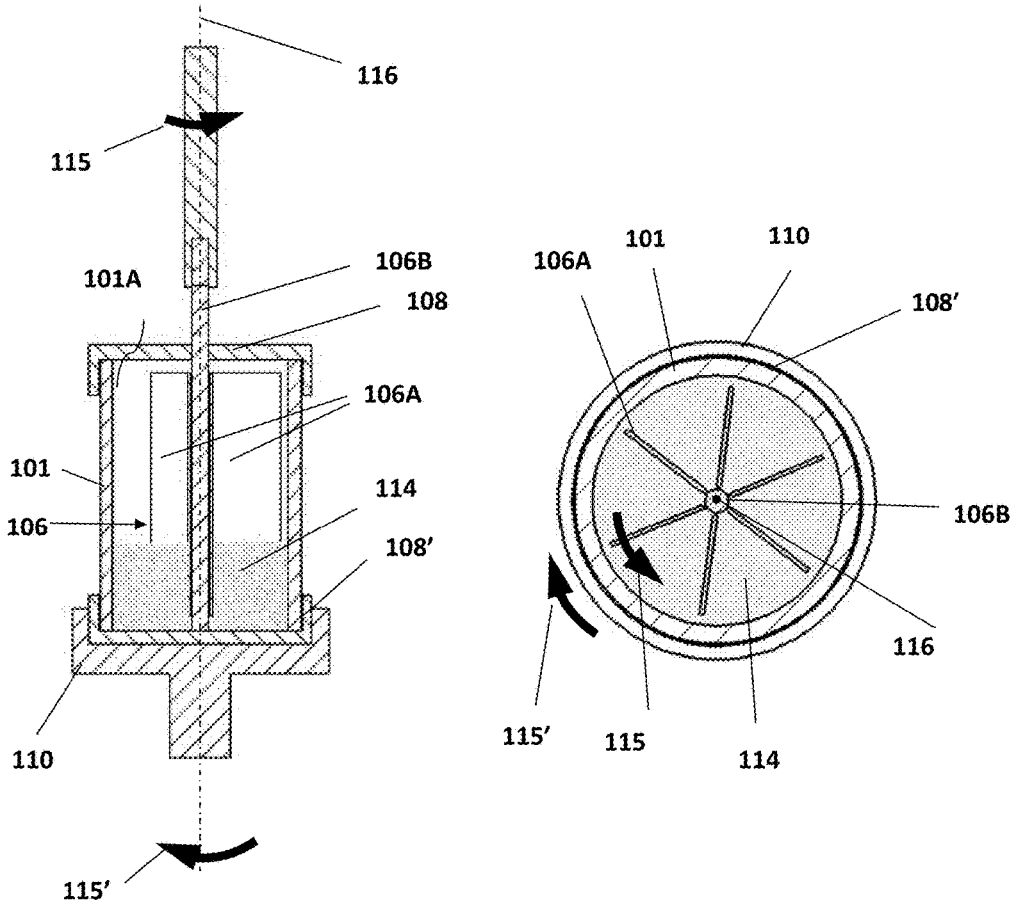
FIG. 4A illustrates two section views of an exemplary stirrer inside the working piece filled with the abrasive nano-particles medium, consistent with one or more exemplary embodiments of the present disclosure.
Figure 6:
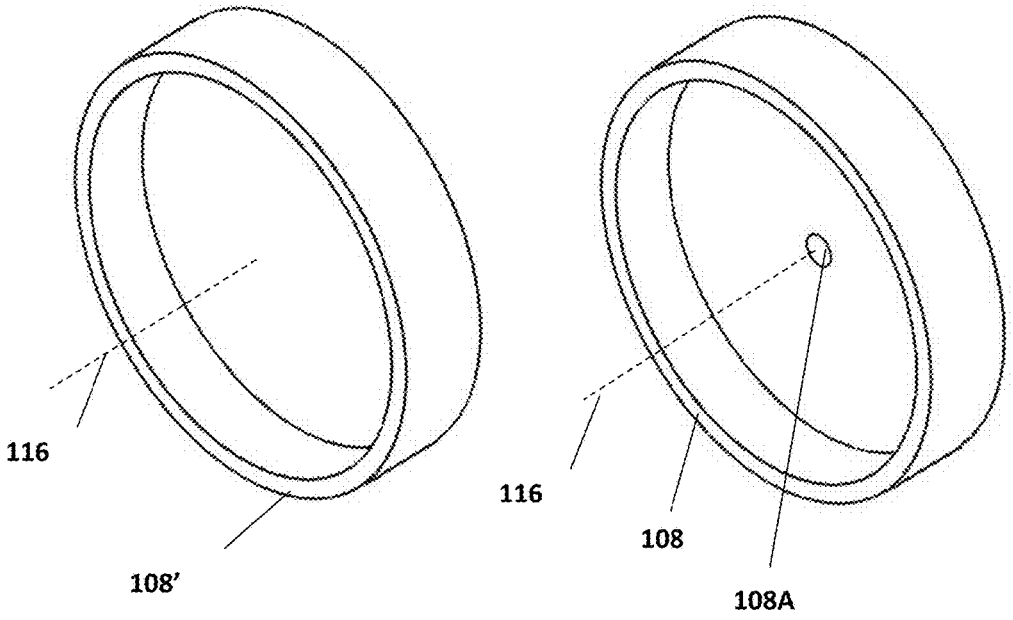
FIG. 6 illustrates a working piece, consistent with one or more exemplary embodiments of the present disclosure.

Referring to FIGS. 1A and 1B, the frame 102 may be configured to consist of an upper segment 102 and a lower segment 102', which is configured to be capable of providing mounting means for the different parts including the rotary actuating mechanisms 104 and 104', which are located on the upper and lower segments of the frame 102, respectively, each one rotatably coupled with either the stirrer 106 at the upper side or the fixture 110 at the lower side Referring to FIGS. 1B, 4A and 6, first, workpiece 101 may be fixed on its fixture 110, and the fixture 110 may be coupled with the lower side rotary actuating mechanism (i.e., second rotary actuator) 104', then the stirrer 106 that may be coupled with the upper side actuating mechanism (i.e., first rotary actuator) 104 through the coupling means which all mounted on the upper side of the frame 102, placed inside the opening 101A, passing through the upper cap's opening 108A as shown in FIGS. 4A and 6, while the inner surface of the opening 101A may be filled with the medium of abrasive nano-particles 114. The stirrer 106 and the workpiece 101 may rotate as a result of the action of respective actuating mechanisms 104 and 104' with their specified rotational speeds, forcing the medium of abrasive particles 114 to rotate with higher velocity and deliver a higher finishing capability. The first and second actuating mechanisms 104 and 104' rotate in an opposite direction as shown by arrows 103 and 103'in FIG. 1B, forcing the stirrer 106 to rotate according to the direction shown by arrow 103 (shown also in FIGS. 2 and 4A as 115), which can be, for example clock-wise, and the workpiece 101 to rotate along the arrow 103' (shown also in FIGS. 2 and 4A as 115'), which can be, for example counter-clock wise.

It is also possible for the apparatus to design in other configurations. For example the apparatus may be configured in the horizontal direction, which forces the workpiece to place horizontally requiring higher centrifugal forces, which also necessitate a higher rotational speeds.

In an aspect, the higher speed of the rotational movements of nano-particles abrasive medium 114 may allow for the finishing process to be performed more efficiently and increases material removal rate and surface quality, compared with other nano-finishing methods, in which the workpiece has no motion.

Figure 2:
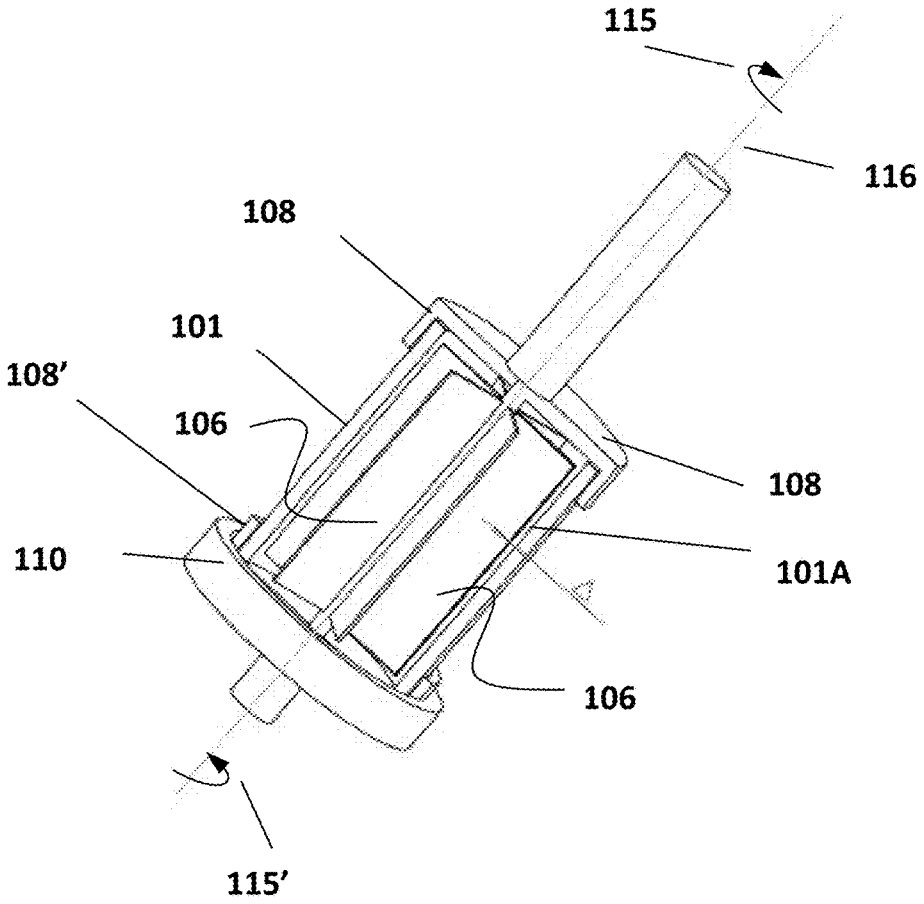
FIG. 2 illustrates a perspective view of an exemplary stirrer inside the workpiece along with its respective caps and fixture, consistent with one or more exemplary embodiments of the present disclosure.
Figure 3A:
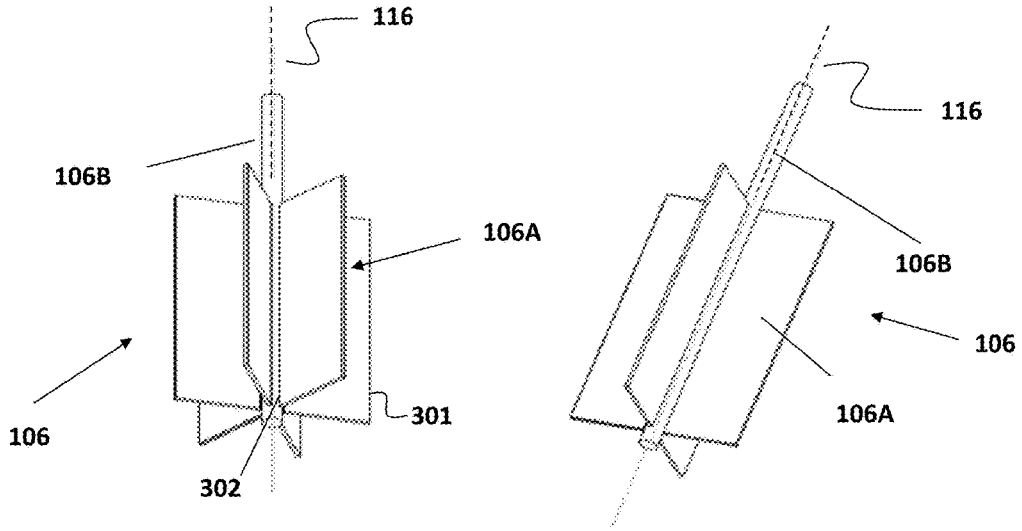
FIG. 3A shows a perspective view of two exemplary rotating stirrers with 4 and 6 rectangular blades, consistent with one or more exemplary embodiments of the present disclosure.
Figure 3B:
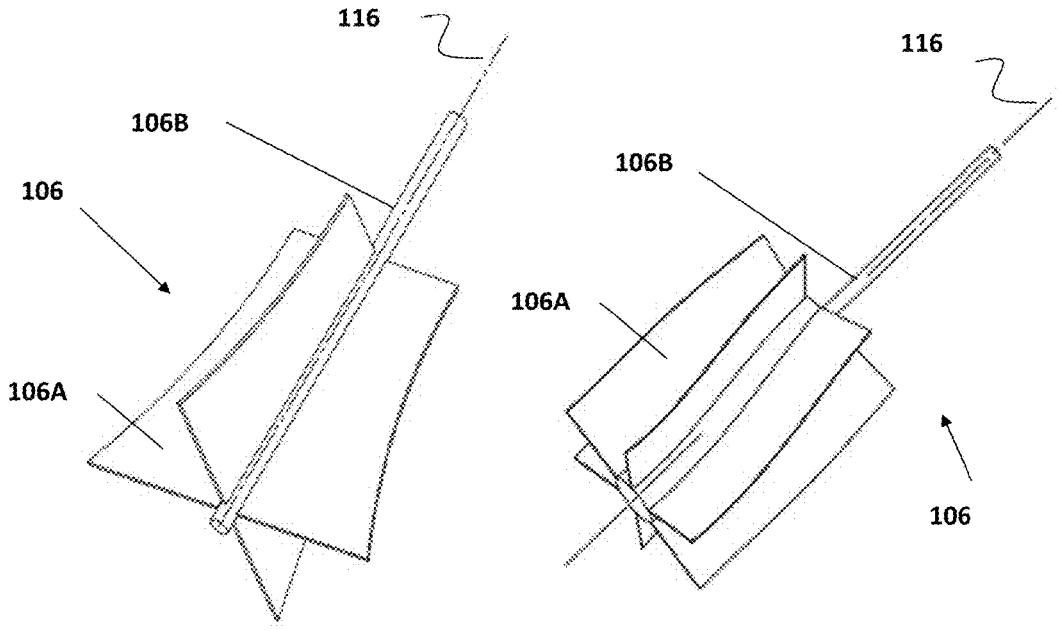
FIG. 3B shows a perspective view of two exemplary rotating stirrers with different shapes of the blades' profiles, consistent with one or more exemplary embodiments of the present disclosure.

FIGS. 3A and 3B show some of the different possible example implementations of the stirrer 106. Referring to FIGS. 3A and 3B the stirrer may include a central shaft 106B on which a plurality of radially extended blades 106A may be mounted. Each blade 106A may have a proximal edge 302 that may be attached to the central shaft 106B and a distal end 301 that may be configured to have a shape such that the horizontal distance between the distal edge 301 and the inner surface of the opening (designated as Δ in FIG. 2) is constant along the vertical length of the blade 106A. The central shaft 106B may be coaxially coupled with the output shaft of the first actuating mechanism 104 and rotatable therewith. The blades 106A may be disposed inside the opening 101A. The blades 106A may be designed according to the shape of the opening 101A, shown in FIG. 4A. Therefore the length, width, size, geometry and angles of blades 106A may be adjustable according to the diameter and geometry of the workpiece. The 4-bladed and 6-bladed stirrers are shown in FIG. 3A as example implementations of the stirrer 106, while other number of blades are also possible. The blades may have different profiles, such as rectangular profile as shown in FIG. 3A, while other profile shapes are also shown in FIG. 3B. The number of blades 106A, their geometries and respective angles are some of the factors which may affect the quality of finishing operation.

Referring to FIG. 2, there is a working gap, shown here as Δ, between the stirrer 106 and the inside wall of the workpiece 101A, which may be filled with the medium of abrasive nano-particles 114 and provides the required space for the finishing process to be performed through the abrasive contacts of the rotating nano-particles and the surface's atoms or molecules. Therefore there isn't any direct contact between the stirring blades 106A and the workpiece 101 compared with the traditional finishing techniques like grinding, honing and lapping, where there is a direct contact between tool tip and workpiece. Therefore, no abrasive heat is generated and there is no need for conventional cooling techniques used in traditional finishing processes. The stirrer 106 may rotate around the longitudinal axis 116 in the direction shown by arrow 115, while the workpiece 101, rotatably mounted on its designated fixture 110, may also rotate around the same axis 116 in an opposite direction shown by arrow 115'. All the elements shown in FIG. 2, including workpiece 101, caps 108 and 108', stirrer 106 and fixture 110 should be configured to be mounted concentrically around the longitudinal axis 116 and no eccentricity is allowed.

The stirrer 106 is not limited in terms of material, and can be made out of metal, plastic, wood and so on, which can be considered as an advantage, resulting in reduced manufacturing cost, while some of limitations of the other nano-finishing procedures can be eliminated such as lower material removal rate, being a time-consuming process and limitations associated with pressure, current and voltage and so on. In addition, the possibility of employing different stirrings with different geometries and sizes can eliminate limitations associated with finishing of some of special parts with cavities and large-diameter parts.

Referring to FIGS. 4A and 6, two caps 108 and 108' may be designed and configured to retain the medium inside the workpiece 101 space during the finishing process. The upper cap 108 may be designed to have a central opening 108A, as shown in FIG. 6, through which the longitudinal axis 116 passes, shown in FIG. 4A. These caps 108 and 108' may be mounted concentrically around the longitudinal axis 116. The use of these caps can save the amount of required medium and its cost, compared with other nano-finishing methods.

Figure 4B:
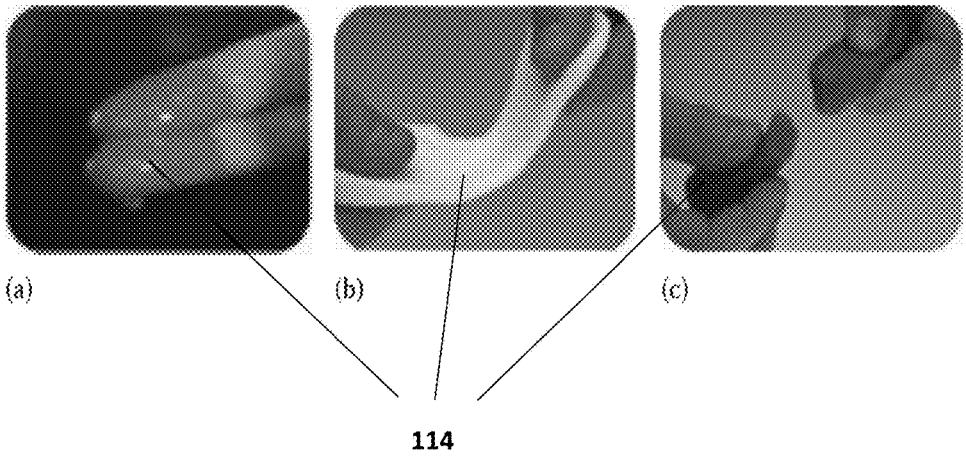
FIG. 4B shows an exemplary view of nano-particles abrasive medium, consistent with one or more exemplary embodiments of the present disclosure.

Referring to FIGS. 4A and 4B, the abrasive nanoparticles may be configured to be a mixture composed of abrasive particles having dimensions in the order of nanometer along with a processing oil which can be mixed with particles and hold them in the mixture, according to one implementation. The nano-particles content and type along with the medium's viscosity affect the quality of this finishing process. The particles can be made of nanometer-sized abrasive particles such as silicon carbide (SiC), boron carbide ($B_4C$), diamond and so on.

Figure 5A:
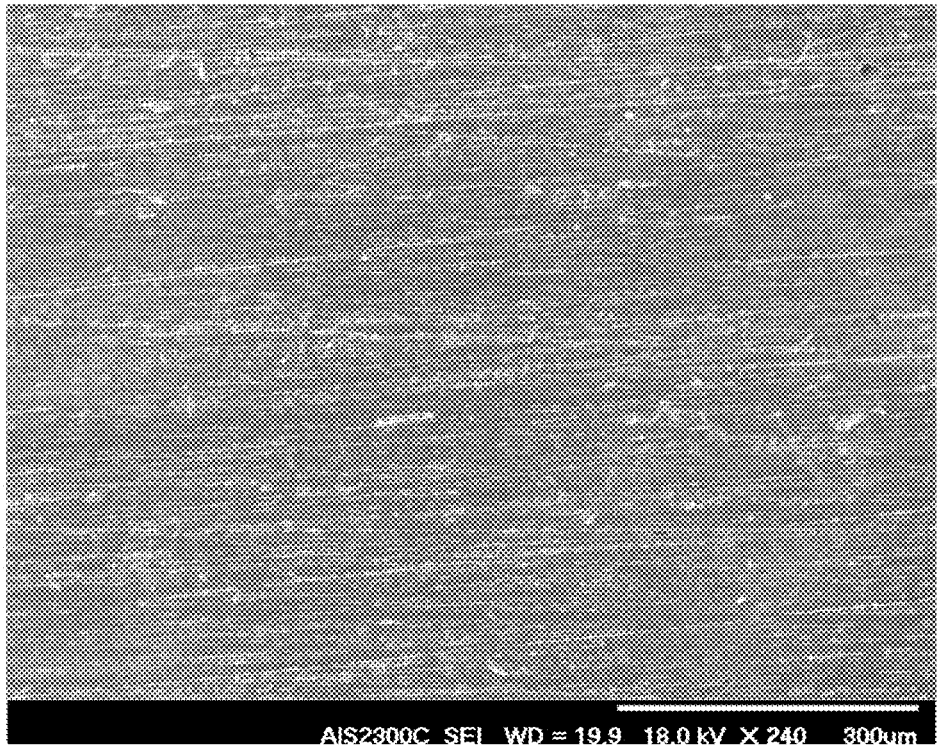
FIG. 5A illustrates an SEM image of the inside surface of the workpiece before applying the new finishing process and apparatus, consistent with one or more exemplary embodiments of the present disclosure.
Figure 5B:
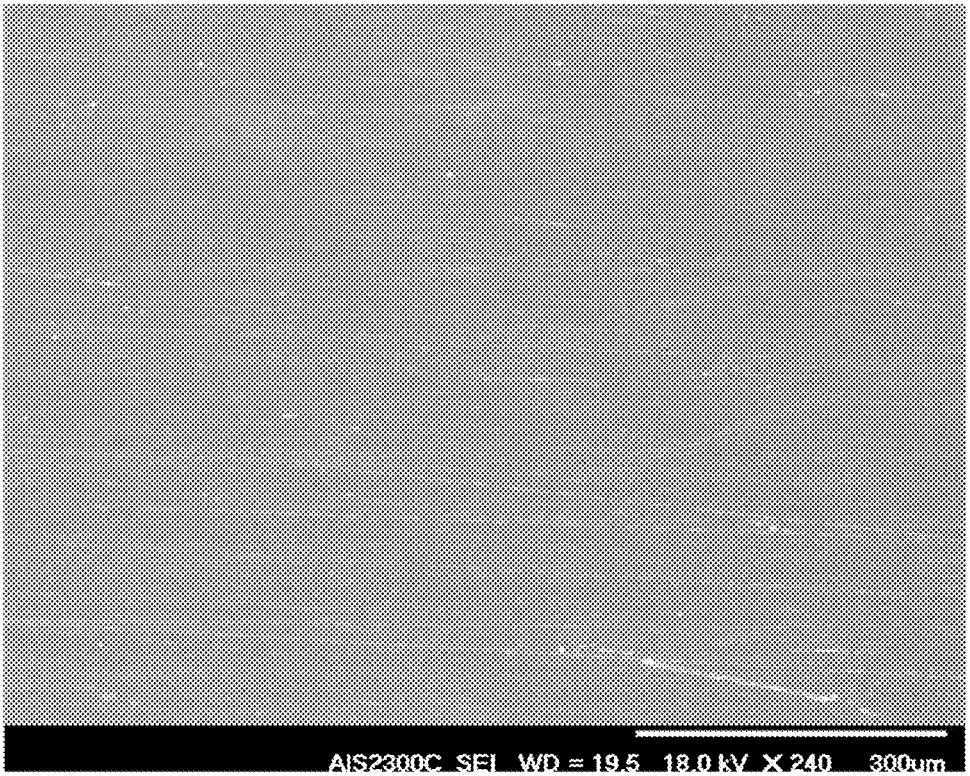
FIG. 5B illustrates an SEM image of the inside surface of the workpiece after using the presented finishing process and apparatus, consistent with one or more exemplary embodiments of the present disclosure.

FIGS. 5A and 5B show two SEM images of the surface of the workpiece before and after employing the current rotational abrasive finishing process respectively. Referring to FIG. 5A, the workpiece 101 inside roughness has been around $R_a$=0.283 micrometer before using the current rotational abrasive finishing method, while it is obtained to be around $R_a$=0.088 micrometer after applying this method, using the disclosed apparatus, referring to FIG. 5B, which clearly indicate the effect of applying this rotational finishing method and its associated apparatus.

Figure 5C:
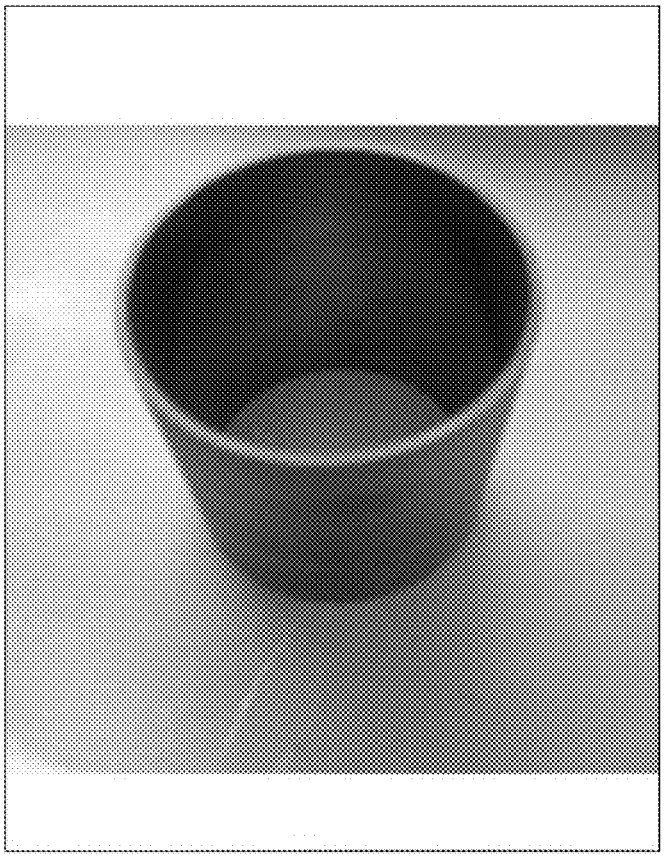
FIG. 5C illustrates a finished workpiece after using the presented finishing process and apparatus, consistent with one or more exemplary embodiments of the present disclosure.

FIG. 5C illustrates a finished workpiece after using the presented finishing process and apparatus, consistent with one or more exemplary embodiment of the present disclosure. For example, using silicon carbide abrasive particles with average diameter of 15.2 micrometer for 10 minutes, an auto cylinder bushing may be made of cast iron with an inside diameter of 83.05 millimeters, as illustrated shown in FIG. 5C. This process may be performed by considering 1 millimeter of a working gap between the inside wall of the workpiece and the rectangular blades of the rotor. The rotational speeds of the workpiece and the rotor may be configured to be 1000 rpm and 2100 rpm. Alternatively, they may be configured to be for 500 rpm and 1700 rpm. The abrasive medium, composed of silicon carbide in a process oil which was a mixture of wax and silicon oil with 50% weight fraction, may be utilized. As shown in FIGS. 5A and 5B the surface roughness of the inside surface of the mentioned workpiece may be improved from $R_a$=0.283 micrometers in FIG. 5A to 0.088 micrometers in FIG. 5A after the process.

What is claimed is:

1. A method for inner surface finishing of a workpiece, wherein the inner surface of the workpiece includes an opening with axial symmetry around a longitudinal axis of the workpiece, the method comprising:

pouring an abrasive medium between blades inside the opening;

rotating the abrasive medium about the longitudinal axis in a first direction within the opening, thereby imposing a centrifugal force on the abrasive medium to accelerate the abrasive medium outwards from the center of rotation towards the inner surface of the opening, wherein the abrasive medium impacts the inner surface; and concurrently rotating the workpiece about the longitudinal axis in a second direction, wherein the first direction is opposite the second direction.

2. The method according to claim 1, wherein the abrasive medium is a mixture of processing oil and nanoparticles.

3. The method according to claim 2, wherein the nanoparticles are selected from the group consisting of boron carbide ($B_4C$), silicon carbide (SiC), and combinations thereof.

4. The method according to claim 1, wherein imposing the centrifugal force to the abrasive medium includes utilizing a rotor to accelerate the abrasive medium outwards from the center of rotation.

5. The method according to claim 4, wherein the rotor is an impeller with blades of various shapes.

6. An apparatus for inner surface finishing of a workpiece, wherein the inner surface defines an opening inside the workpiece with axial symmetry around a longitudinal axis of the workpiece, the apparatus comprising:

a fixture configured to house and grip the workpiece;

a stirrer having a central shaft and a plurality of radially extending blades connected to the central shaft and rotatable therewith, wherein the blades are disposed within the opening defined by the inner surface of the workpiece;

a first rotary actuator coupled to the central shaft and configured to drive a rotational movement of the stirrer about the longitudinal axis in a first direction; and a second rotary actuator coupled with the fixture and configured to drive a rotational movement of the fixture about the longitudinal axis in a second direction, wherein:

the first direction is opposite the second direction;

the abrasive medium is poured between the blades, inside the opening; and the stirrer is configured to accelerate the abrasive medium outwards form the center of rotation towards the inner surface of the opening.

7. The apparatus according to claim 6, wherein the radially extending blades have a proximal edge and a distal edge, wherein the proximal edge is configured to be connected to the central shaft and the distal edge is shaped such that the horizontal distance between the distal edge and the inner surface of the opening is constant along the vertical length of the blades defining a working gap.

8. The apparatus according to claim 7, wherein the working gap defines a contact zone for abrasive medium to rotate and impact the inner surface of the opening to perform surface finishing operation.

9. The apparatus according to claim 6, further comprising an upper cap and a lower cap placed at either sides of the workpiece and tightly fixed thereon, configured to retain the abrasive medium inside the opening.

10. The apparatus according to claim 9, wherein the upper cap is configured with a central opening for the central shaft to pass through.

11. The apparatus according to claim 8, wherein the stirrer, the upper and lower caps are coaxially placed around the longitudinal axis of the workpiece without any eccentricity.

12. The method according to claim 4, wherein rotating the abrasive medium about the longitudinal axis in a first direction within the, opening comprise rotating the abrasive medium by rotating the impeller placed within the opening.

13. The method according to claim 1, wherein concurrently rotating the workpiece comprises rotating a fixture corresponding to shape of surface of the workpiece, wherein the workpiece is coupled to the fixture.

* * * * *